United States Patent [19]

Eaton

[11] 4,023,729

[45] May 17, 1977

[54] GROUP COMMUNICATIONS SYSTEM

[76] Inventor: Roger W. Eaton, 807 N. HyPerion Ave., Los Angeles, Calif. 90029

[22] Filed: Oct. 15, 1975

[21] Appl. No.: 622,557

[52] U.S. Cl. ..... 235/52

[51] Int. Cl.[2] ..... G07C 13/00

[58] Field of Search ..... 235/52, 54 F

[56] References Cited

UNITED STATES PATENTS

| | | | |
|---|---|---|---|
| 3,190,014 | 6/1965 | Rhodes | 235/52 X |
| 3,748,646 | 7/1973 | Schultz et al. | 235/52 X |
| 3,947,669 | 3/1976 | Simmons et al. | 235/52 X |

*Primary Examiner*—Stanley J. Witkowski

[57] ABSTRACT

A system is provided for facilitating free communication of group attitudes and responses through a series of group decisional processes based on voting. In the preferred form, a vote selector unit, such as a keyboard provides each voting entity within the group with means to choose one of a variety of informational characters, such as the letters of the alphabet and appropriate punctuation marks, in sequence to form a message in response to an inquiry or other stimulus. A data processing system senses an electrical signal output from each vote selector means to record and tabulate the choice of each voting entity during successive discrete polling intervals and counts the total votes accorded each informational character during each such interval. The total votes thus counted for each informational character are successively compared to determine the specific character or characters that received a predetermined plurality of the votes during each such polling interval. The character or characters so determined are then displayed and communicated to the group before the next polling interval to form the next succeeding element of the message. During each succeeding polling interval, the individual voting entities are informed of the previous selected elements of the message so that each subsequent voting determination can be based on prior decisions.

10 Claims, 6 Drawing Figures

GROUP COMMUNICATIONS SYSTEM

BACKGROUND OF THE INVENTION

Studies of group attitudes and psychology depend upon establishing communication with a group as a whole, rather than as separate individuals. Present mass communication techniques are very effective in communicating information to large groups, but are seriously defective in allowing the group to effectively communicate accurate expressions of its own collective feelings or intent. Current opinion research relies for the most part on "yes-no" response or multiple choice techniques. These techniques impose severe limitations on the scope of group impression since each question asked must be carefully structured to elicit the specific response desired while minimizing collateral considerations that might otherwise interfere with the response to be elicited.

For example, political opinion analysts may use existing opinion survey techniques to determine whether a group favors or opposes a particular candidate or issue, but otherwise be unable to discover subtle reasons underlying the group decision. A multiple choice statement of reasons can only cover known categories and runs the risk of misstating or oversimplifying the true attitude held by most group members. If the reasons given do not fit individual interpretations, the tendency would be to select generalized statements to avoid inaccurate commitment to more closely held viewpoints. Uncertain or curious results obtained with existing techniques must be examined in later surveys after the initial results have been tabulated and analyzed, and the resultant delay may well give rise to a significant change of circumstances that obscures the reasons behind the previous survey responses.

The same limitations apply in experimental studies of group psychology. With existing techniques, it is difficult to allow the group free expression as an entity, or to test the instantaneous shifts in group attitude as a sequence of events unfolds.

Previous attempts have been made to obtain free group communication through voting on individual letters or segments of a message, but the methods employed were cumbersome making effective communication with a group of any size a very time consuming and difficult task. In groups of any size delays encountered in tabulating each successive vote had the undersirable effect of interfering with the participants' concentration and patience, thereby tending to produce noticably cryptic, incomplete and sometimes frivolous responses. Therefore, effective use and study of such group communication techniques would seem to depend upon minimizing tedious delay and facilitating the ability to express full and complete ideas without undue effort. Rapid tabulation and presentation of the voting results on successive message components should not only stimulate and maintain the interest of the group members in the communication process, but also greatly faciliate use of immediate follow-up techniques, such as the propounding of additional inquiries to clarify uncertain or ambiguous responses or delve into the reasons behind certain reactions. The group members can thus act to express themselves as a single entity.

SUMMARY OF THE INVENTION

Generally the system of the invention provides a plurality of vote selector units for allowing the individual voting entities as members of the group to choose a variety of informational characters to form in sequence the first and each succeeding element of a message. In the preferred form, each of the vote selector units consist of a keyboard or the like containing all letters of the alphabet with appropriate spacing and punctuation marks necessary to form a written message. Upon actuation, each unit generates an electrical signal indicative of the particular informational character selected in a given polling interval, during which each voting entity may select any character to be the first letter in the message being formed.

The signal outputs from all the selected units are coupled through a multiplexer unit to be delivered one at a time to a demultiplexer/decoding circuit that automatically responds to the signals from the vote selector unit to identify the specific character selected and deliver a count signal to an appropriate one of a series of counters that are connected to register the total vote count for each character during each polling interval. Upon completion of the polling interval, the total number of votes registered in each counter is compared against the others, or against a preselected count total, to determine which character or characters received the most or a predetermined plurality of the votes during the preceding polling interval. The number of votes received by each character may be displayed for the benefit of the interrogator or operator so that significant secondary choices can be noted, whereas, the character or characters determined to have the greatest number of votes are appropriately displayed to the group as forming the next element of the message being formed. Thereafter, the central processor initiates another polling interval wherein the voting entities again activate each of the selector units to choose the next succeeding element of the message based on the display of prior message elements.

In its preferred form, the system is provided with a central processor unit that compares the vote totals registered in each counter to determine the winning character in accordance with a preselected operational sequence. Manually operated panel controls can be used to modify the operation of the central processor in various ways to control automatically the time duration or total votes received during each polling interval and to signal the selection of the winning character whenever the total count for any character exceeds a given value. Appropriate controls are also provided to permit multiple votes from a single selector unit during each polling interval so that the number of voting entities can be increased without the need for additional equipment.

DETAILED DESCRIPTION

Figure 1:
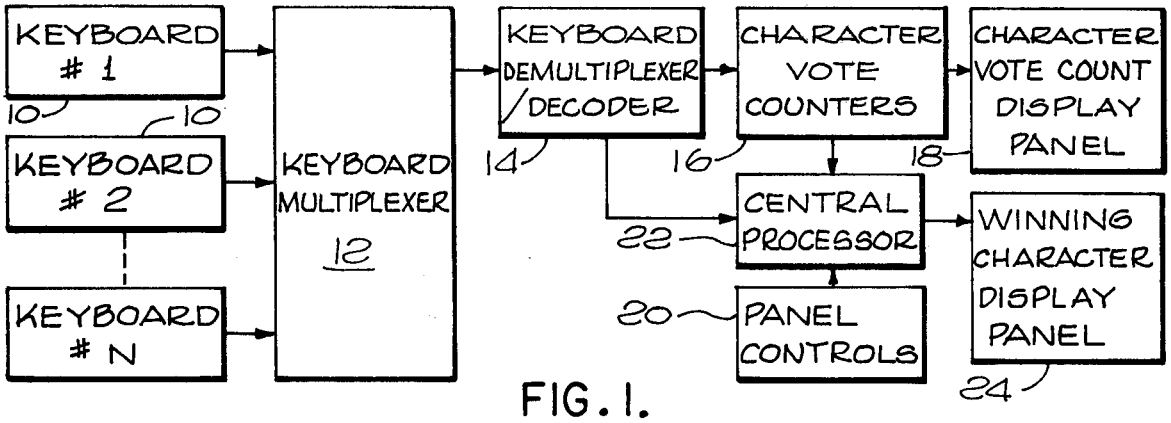
FIG. 1 is a block diagram illustrating the major components of a group communication system in accordance with the invention.

Referring now to FIG. 1, wherein the basic operational components of a system in accordance with the invention are shown in block diagram form, a number of vote selector units 10 are provided so that one is available to every voting entity within the desired group. Each voting entity may consist of a single person or subgroup of persons that can function to select a single informational character during a single polling interval. Each voting entity is required to register its vote within such a polling interval to have it recognized and counted in determining a particular element of the message being formed by the group.

The preferred form of the system described herein incorporates the features of an existing design intended for use with a limited group size for experimental purposes in studying the psychological aspects and general versatility of such systems for larger groups that conceivably could encompass the public at large. These specific components and operational parameters described in conjunction with the existing system employ conventional circuit elements and data handling techniques to minimize the cost of construction while the accuracy and speed requirements for the limited group size. For example, the existing system is designed for about one hundred voting entities within the group. Those skilled in the art will recognize the need for more sophisticated data handling equipment, such as general purpose digital computer equipment with remote terminal time sharing and multiplexing techniques, in handling much larger and geographically dispersed voting groups. Appropriate modification to the existing system design to meet the increase speed and accuracy requirements imposed by much larger groups should be apparent to those skilled in the art of data transmission communication and will thus not be described in any detail herein, but only briefly mentioned when appropriate to assist in a complete understanding of the invention.

The vote selector units 10 may consist of any conventional keyboard assembly with the desired number of selector keys corresponding to a variety of informational characters. These keyboard selector units should be capable of identifying each character with an appropriately coded multidigit output signal. Preferably the keyboard or other form of character selector unit contains a total of 32 character selector keys to include the 26 letters of the alphabet plus appropriate punctuation such as the period, comma, question mark, space, end of message indicator, and if desired a "no vote" indicator. Such keyboards would be used primarily for forming messages one letter at a time, but could be used to select whole words or phrases presented to the group in the form of various conversion tables based on the prior message content.

With 32 informational characters, the output from each keyboard could conveniently be in the form of a five digit binary coded signal capable of being transmitted in serial or preferably parallel form to be used with conventional digital equipment. The outputs signals from each keyboard selector unit 10 are connected to a keyboard multiplexer 12 that operates generally to collect all of the coded vote output signals for delivery in orderly fashion as discrete informational groups to a keyboard demultiplexer/decoder 14. As explained hereinafter in connection with FIG. 3, the keyboard multiplexer 12 may take various forms depending upon the total size and dispersion of the voting group. Generally the keyboard multiplexer 12 reproduces the character identification code from the keyboards 10 in identical or similar form to actuate the corresponding output from a keyboard demultiplexer/decoder 14 that is supplied to increment the numerical count contained in one of an array of character vote counters 16. Each of the character vote counters 16 is connected to a respective decimal indicator unit in a character vote display panel 18 that is actuated to display the decimal digits corresponding to the total vote count registered in the respective counters for each character at the completion of a polling interval.

Thus each polling interval constitutes the period of time during which vote signals generated at the individual keyboard selector units 10 are supplied to the character equals counters 16 to be used in determining the informational character that constitutes the next element of the message being formed. Each polling interval can be terminated automatically at the end of a predetermined time period, or upon receipt of a predetermined maximum number of votes corresponding to the total number of voting entities, or can be manually controlled by the operator through a switch contained in an arrangement of panel controls 20 connected to regulate the operation of a central processor 22. Upon determining the end of a polling interval, the central processor 22 initiates comparison of the total vote count registered in each of the character vote counters 16 to ascertain which contains the greatest plurality of votes. After comparing the vote count in each counter, or upon determining that one counter contains a predetermined plurality, the central processor 22 delivers a signal identifying the particular counter to a winning character display panel 24 where the newly chosen character is visually communicated to each member of the group, preferably together with one or more of the previously determined message elements. Thereupon, the central processor 22 either automatically or at the command of an operator initiates a new polling interval to select the next message element.

In certain circumstances, it may be desirable to display or otherwise retain indications that a particular character has received a significant proportion, although not the greatest number of votes, and as may happen sometimes, a tie vote may be encountered. In the case of an infrequent tie vote, a single winner may be selected on a random basis, but the operator may wish to explore the possible alternatives presented by the other randomly rejected character. Also the operator may wish to deliberately select the character that receives the second or third greatest number of votes to study group reactions where by message content is controlled by lesser pluralities within the group, thereby frustrating the numerically stronger contigent. This might thus be termed communication by a "subvoice" within the group, rather than the primary voice of the group itself.

Figure 2:
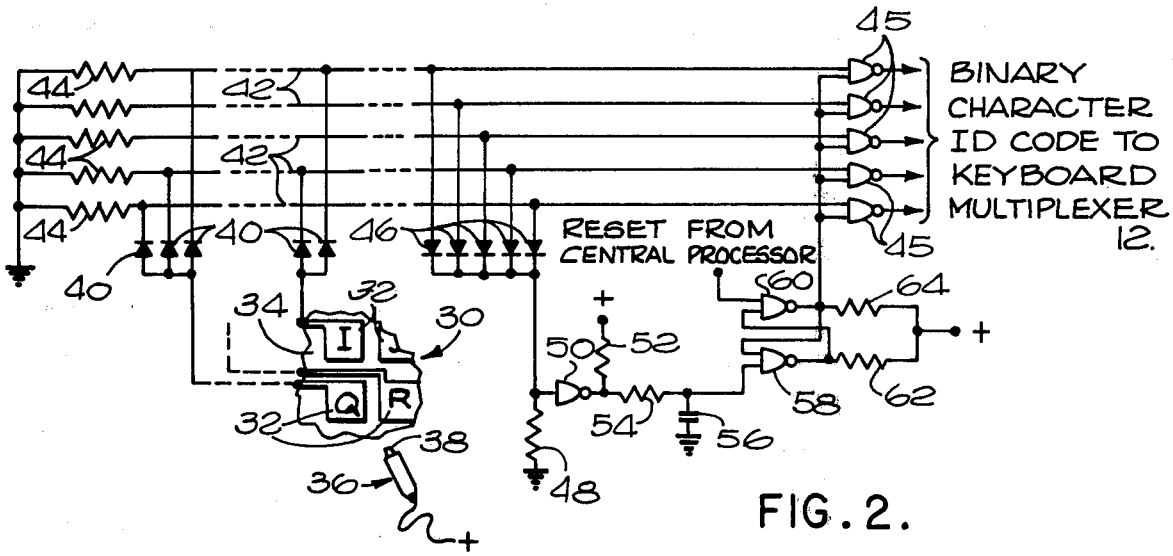
FIG. 2 is a schematic circuit diagram, including a partially broken way section of a printed circuit board, that illustrates a simplified selector unit for use in the preferred form of the invention.

Referring now to FIG. 2, a simplified design for the keyboard selector units 10 employs a printed circuit board arrangement 30 containing discrete areas of conductive material 32 formed on the outer surface of a rigid insulative backing 34. As shown in the drawing, each discrete conductive area 32 may be deposited or etched by conventional circuit board techniques to form a square with a narrow connecting strip extending outwardly towards the board periphery for convenient connection to other circuitry mounted on the board itself preferably behind the board within an appropriate housing. The illustrated circuit board arrangement 30 has a total of 32 discrete conductive areas 32 arranged in four horizontal rows of eight squares each. Each of the squares has imprinted thereon a visual representation of a respective one of the characters to be selected, which in this case constitute the letters of the alphabet plus appropriate punctuation marks. An electrical pointer 36 that has an exposed metal tip 38 held within an insulative outer body such as plastic is connected by a flexible wire to an operating voltage supply of approximately five volts positive. The electrical pointer 36 is held and moved by hand to any one of the square conductive areas 32 during successive polling intervals to indicate selection by the voting entity of the particular informational character imprinted on a respective surface.

Each of the discrete conductive areas 32 is electrically coupled through one or more forward connected diodes 40 to different ones of five code lines 42, each of which is grounded through a respective load resistor 44 to the common or ground potential. Each code line 42 is coupled to an input of a NAND gate 45 that is enabled to generate appropriately timed pulses at its output indicative of the binary code used to identify the specific character selected.

Each of the code lines 42 is coupled through a respective forward connected diode 46 to apply the positive voltage appearing on any one of the code lines 42 across an input resistor 48. The five diodes 46 are connected in parallel to provide a logical OR function so that a positive going signal is applied across the input resistor 48 to a NAND gate 50 whenever the keyboard operator touches one of the conductive areas 32 with the pointer 36 to select a given character. The output of NAND gate 50 is connected through a dropping resistor 52 to the positive operating potential and through an output resistor 54 to a timing capacitor of 56. When no character is being selected, the output of the NAND gate 50 is high and the timing character 56 is charged from the positive current flow through the dropping resistor 52 and the output resistor 54. When a character is selected by the pointer 36, the output of the NAND gate 50 goes low to discharge the normally high voltage on the capacitor 56 through the output resistor 54. The voltage across capacitor 56 is applied to one input of a NAND gate 58 that is interconnected with another NAND gate 60 to form a bistable multivibrator or flip-flop arrangement, with the output of each connected to the input of the other and both outputs connected through a respective dropping resistor 62 or 64 to a positive supply potential. The output of the NAND gate 60 is also connected as an input to enable each of the code line output NAND gates 45.

In operation, at the start of each polling interval, the bistable arrangement is placed in its normal reset state with the output of NAND gate 60 high, while the output of NAND gate 58 is low. The high output of NAND gate 60 enables the NANDgate 45 to respond to a positive voltage applied to their respective code lines 42, thus causing the respective outputs to go low in accordance with the binary code connections for the specific characters selected. At the same time, the positive voltage for the diodes 46 actuates the NAND gate 50 acting as an invertor to initiate discharge of the positive voltage across the capacitor 56 through the resistance 54. The values of resistor 54 and capacitor 56 are chosen to provide a RC time constant for discharging capacitor 56 so that the voltage at the input of NAND gate 58 reaches a cut-off level of approximately 0.70 volts after 300 microseconds. The output of NAND gate 58 then goes high and is applied as an input to enable the other NAND gate 60 causing its output to go low to disable each of the code line output gates 45. The other input to the NAND gate 60 is the "reset" signal from the central processor 22 that remains high until the end of a polling interval at which time a negative going or low "reset" pulse is applied to switch the bistable arrangement back to its original reset state by causing the output of NAND gate 60 to again go high to enable the other NAND gate 58 as well as each of the code line ooutput gates 45 in preparation for receiving another vote. In this way, each keyboard selector unit 10 can produce only a single vote outut until a reset signal is received from the central processor 22 which would normally be at the end of a polling interval. However, as explained hereinafter, a reset pulse might be provided at an intermediate time during a polling interval to permit two or more votes from each keyboard selector unit 10 so that the number of voting entities may be increased using the same number of units.

Figure 3:
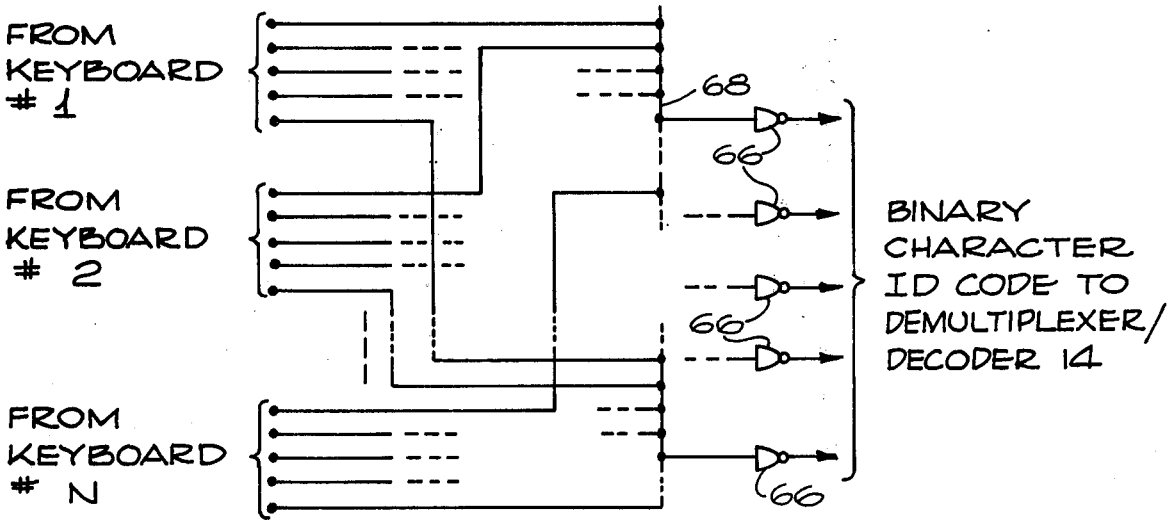
FIG. 3 is a partial schematic circuit drawing illustrating the connections within a multiplexer unit of the coded output signals from the simplified keyboard selected units of FIG. 2.

Referring now to FIG. 3, a simplified form of keyboard multiplexer can be employed with the existing design illustrated herein because of the limited number of keyboard selector units 10. In this design, the same bit outut from one of the output NAND gates 45 of each keyboard selector unit 10 is coupled together with the corresponding bit output from each of the other units 10 at the input of a particular one of five NAND gates 66. Each NAND gate 66 produces an inverted output of one bit from the five bit character identification code being generated by any one of the N keyboard selector units 10. For example, the output from the uppermost NAND gate 45 shown in FIG. 2 may represent the most significant bit in the character identification code, and this output is connected with the corresponding output from all of the other units 10 to a single signal bus 68 at the input to the uppermost multiplexer NAND gate 66 shown in FIG. 3. Similarly the output from the lowermost NAND gate 46 shown in FIG. 2, which may represent the least significant bit in the character identification code, is connected to its own signal bus at the input of the lowermost multiplexer NAND gate 66 shown in FIG. 3, while the other three output bits of intermediate significance are connected to its own signal bus at the input of another corresponding one of the multiplexer NAND gates 66. Thus, each time one of the keyboard selector units 10 is actuated, the five multiplexer NAND gate 66 respond to produce an inverted pattern of outputs according to the voltge appearing on the respective code lines 42 within the particular keyboard selector unit 42.

This simplified multiplexer arrangement is feasible in this design because of the short duration of the output pulse signals generated by the timing arrangement within the keyboard selector units 10 and the limited number of keyboard selector units 10. Thus, assuming a five second polling interval and only about one hundred voting entities, there exists little probability that the 300 microsecond pulse output from one keyboard selector unit 10 would be coincident with that from another; but, even if it were coincident the resulting error would have little effect in assessing relative vote totals since the combination of two character codes would almost always produce a code indicative of some character other than those actually receiving significant numbers of votes during any particular polling interval.

Figure 4:
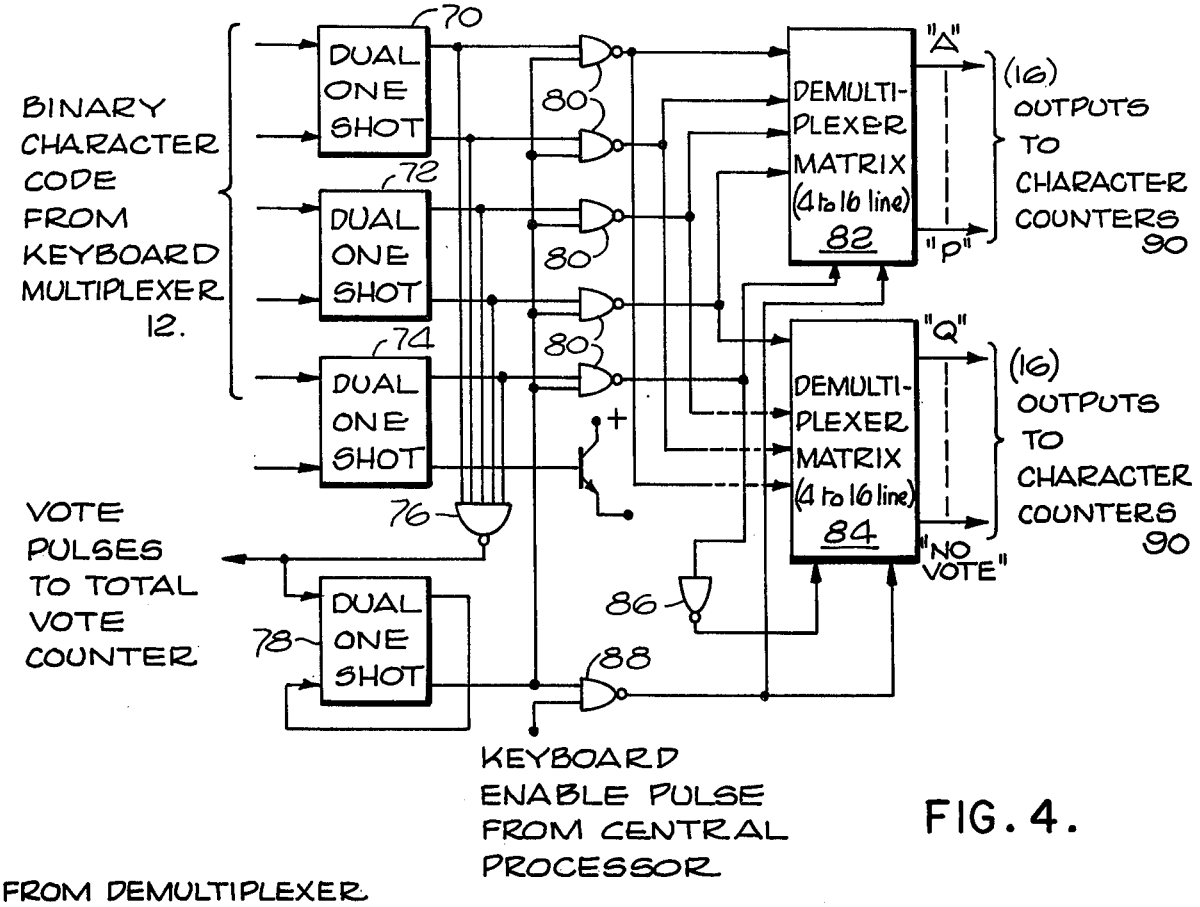
FIG. 4 is a schematic circuit drawing shown partially in block diagram form, illustrating the decoder/demultiplexer unit for detecting the character indicated by the signal code received from the keyboard selector units of FIG. 2 through the multiplexer unit of FIG. 3.

Referring now to FIG. 4, the output of each multiplexer NAND gate 66 is applied to the input of a respective one shot multivibrator, which as shown may form one half of a conventional dual one shot circuit 70, 72 or 74, such as the integrated circuits commonly identified by the designation 74123. Each of the five multivibrators receives a respective one of the five bits forming the binary character code output from the keyboard multiplexer 12. When the respective bit input goes high, the multivibrator is set to produce a short duration output pulse that remains low for a predetermined interval, such as 400 microseconds. Each of the five pulse outputs from the dual one shot circuits 70, 72, and 74 are then coupled as inputs to NAND gate 76 so that its output goes high each time a character identification code from one of the selector units 10 is received, thus generating a positive vote pulse for each vote registered so that a total vote count during a polling can be determined as hereinafter described. Each vote pulse appearing at the output of the NAND gate 76 is also applied as an input to another dual one shot circuit 78 that is also a 74123 element. The leading edge of each positive going vote pulse triggers the first half of the dual one shot 78 to produce a negative going output pulse with a duration slightly less than one half that of the character identification code pulses applied at the inputs of the other dual one shots 70, 72 and 74; thus, for example, the pulse from the first half of the dual one shot 78 has a 125 microsecond duration as compared to the three hundred microsecond pulse inputs to the dual one shots 70, 72 and 74. The shorter duration pulse from the first half of the dual one shot 78 is applied as an input to the second half to trigger at its trailing edge, which is going high, a very narrow pulse with a duration of several microseconds. This narrow pulse is applied to enable each of five NAND gates 80 that also receive the coded output pulses from the dual one shot circuits 70, 72 and 74, thus sampling each code input pulse information at approximately its midpoint. By delaying this sampling operation, the outputs from NAND gates 80 are not subject to signal transients caused by mechanical bounce of the metal pointer tip 38 when it is initially placed in contact with one of the discrete conductive areas 32 formed on the selector unit circuit board 30.

The narrow pulse samples of the character identification code bits that are generated at the outputs of the NAND gates 80 are applied as inputs to a pair of four-to-sixteen line demultiplexer matrices 82 and 84, which may be standard 74154 integrated circuit components innerconnected to form a five-to-thirty-two matrix that provides an output pulse on the particular output line indicated by the binary coded input. The pulse sample from one of the NAND gates 80 that samples the output from the dual shot 74 is applied to actuate the first demultiplexer matrix 82, while also being delivered through an inverting NAND gate 86 that maintains the other matrix 84 normally actuated except when the first matrix 82 is actuated. The sampling pulse generated by the one shot 78 is also received by a NAND gate 88 that remains enabled by a keyboard enable signal from the central processor during each polling interval. The output of this NAND gate 88 is likewise connected to the demultiplexer matrices 82 and 84 to enable them only when the code bit samples are being supplied from the NAND gates 80 so as to prevent any outputs to the character counters due to signal transients or other stray interferences.

Figure 5:
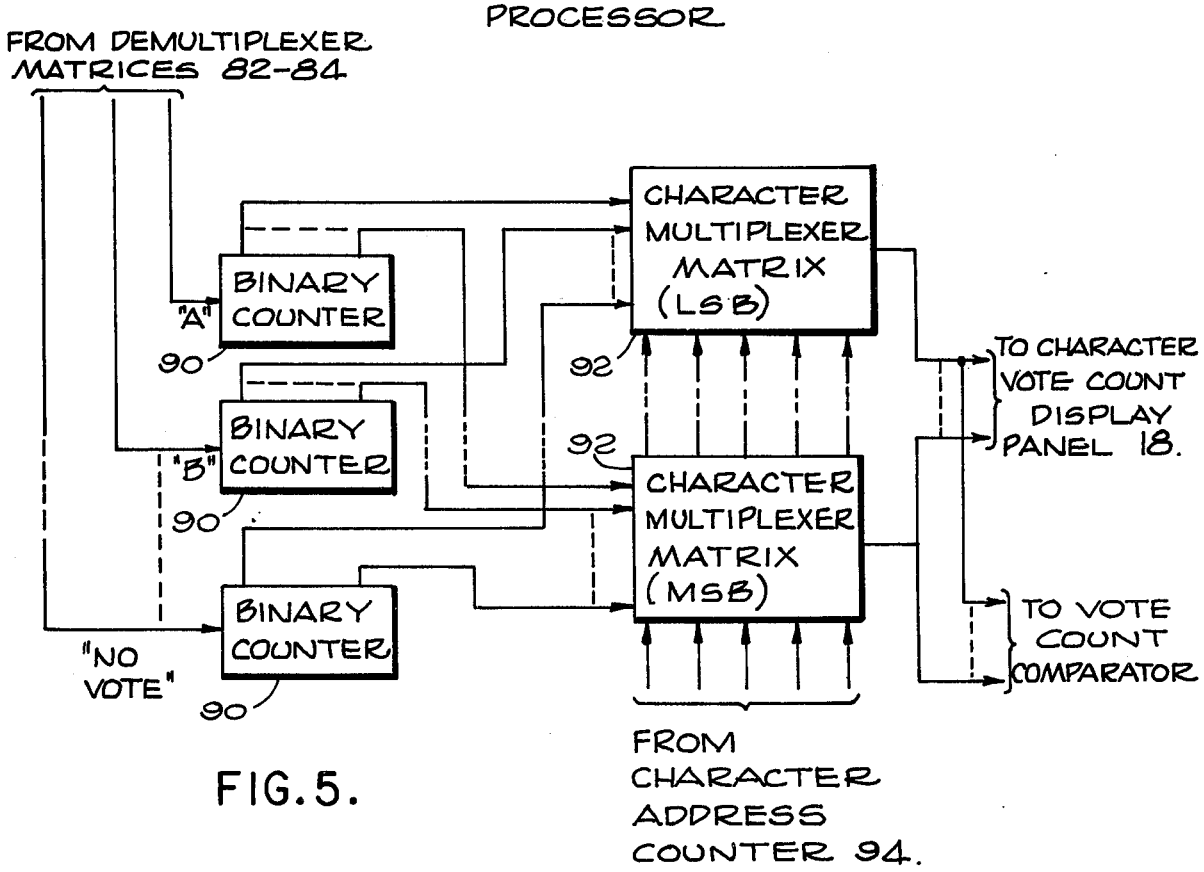
FIG. 5 is a schematic block diagram illustrating the arrangement of character vote counters for registering and transferring the total vote received by each character during each polling interval.

Referring now to FIG. 5, each of the 32 character pulse outputs from the two demultiplexer matrices 82 and 84 are connected to the input of a corresponding pulse counter 90. Preferably each binary counter 90 consists of conventional binary coded decimal 8280 integrated circuit counters cascaded in series to have a total capacity equal to at least half of the total number of voting entities participating. For example, two series connected binary coded decimal counters providing a total vote count of one hundred would suffice for as many as two hundred voting entities.

Larger voter populations of several hundred or more can satisfactorily be accommodated by the existing system illustrated herein merely with the addition of another binary coded decimal counter stage. The voting capacity can be significantly increased to several thousand simply by having different subgroups vote during different selected portions of an extended polling interval or by use of more sophisticated keyboard selector and conventional multiplexing techniques to prevent substantial overlapping of the character code signals delivered for decoding and counting. For much larger voter populations that are dispersed geographically, a selector and counting system as described hereinabove might be used for each of a number of smaller subgroups defined within a specific geographic or telephone exchange area.

For example, the system might be expanded for use with a radio or television audience to whom the questions and successive polling results are broadcast in accordance with the voting selections transmitted over telephone lines. Each geographical or telephone exchange grouping would be divided into subgroups of several hundred voter entities apiece with selector inputs coupled to a simplified multiplexing and counting system as described hereinbefore to register the vote totals for each character within the subgroup. Then, using conventional multiplexing and data transmission techniques, the vote counters registering the totals for each subgroup could be interrogated sequentially to transmit the vote count totals for each character to a central collector station to be added to the totals from other subgroups with the resulting sum used in ascertaining the winning character for the entire population. In such a system, the efficiency of data registration and transmission would be enhanced by employing standard binary counters at each substation instead of the binary coded decimal counters, which are preferably employed only to register the totals being accumulated at the central station. Similar modifications of the system components described herein to facilitate efficient handling of such large voting populations should be obvious to those skilled in these arts.

The four binary stage outputs from each counter 90 are each connected to an input of a different character multiplexer matrix 92 that receives the same bit from each other counter 90. For example, as illustrated, the least significant output (LSB) bit from each of 32 (or 31) binary counters 88 is connected as a separate input to a character multiplexer matrix (LSB) 92 whereas the most significant bit (MSB) from each counter is similarly connected as a separate input to another respective character multiplexer matrix (MSB) 92. A five bit binary character address code applied simultaneously to the character multiplexer matrices 92 causes each bit contained in a corresponding binary counter 90 to be read out in parallel through the respective character multiplexer matrices 92. As hereinafter explained, the character address code is obtained by successively incrementing a binary address count to address each character in sequence thus reading out in parallel the binary bits registered in the associated binary counter 90. These binary coded decimal bits are then applied to a suitable decimal digit readout unit, such as Nixie tube or segmented bar display (not shown), for visually indicating the number of votes received by each character during the preceding polling interval.

Figure 6:
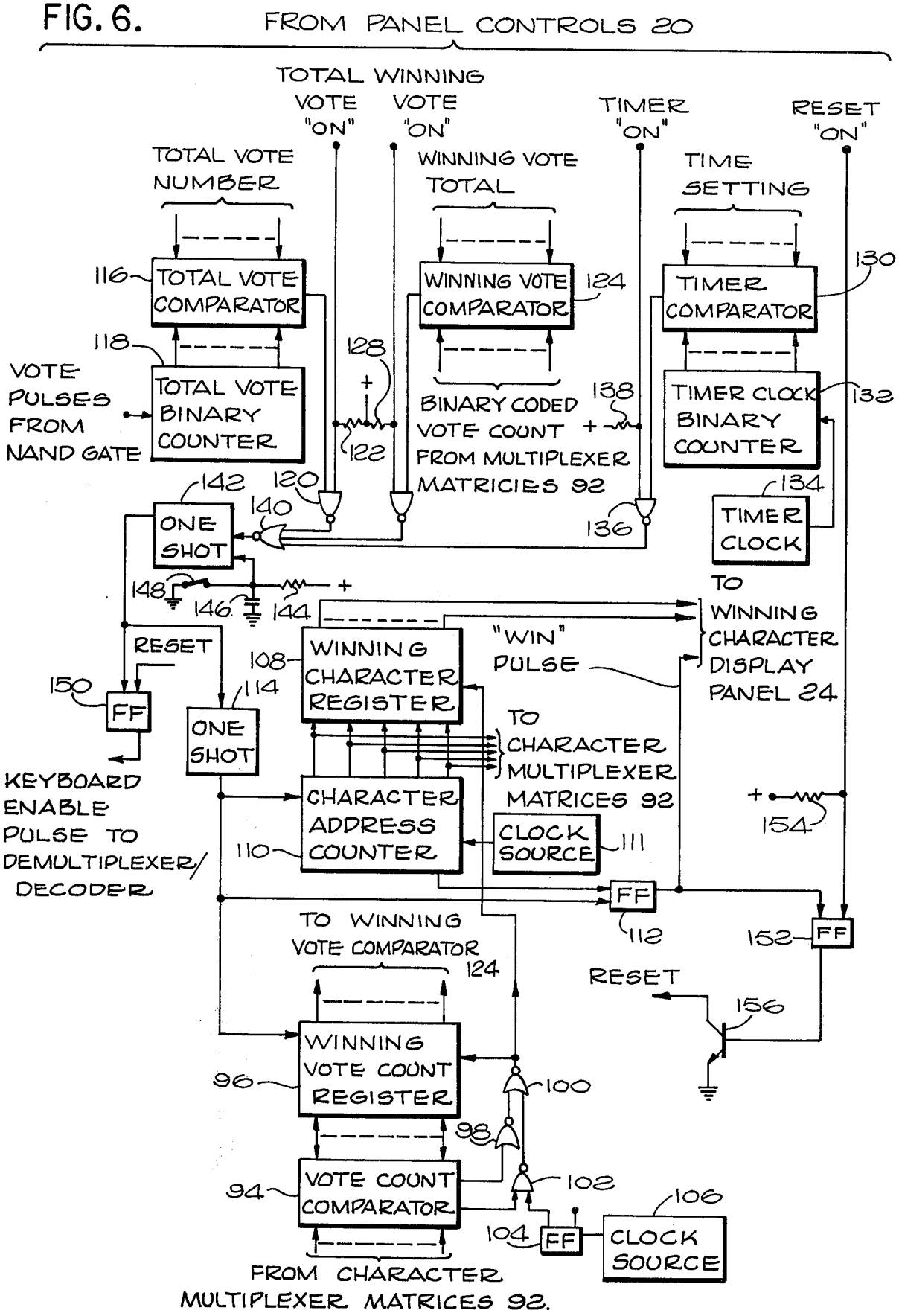
FIG. 6 is a schematic circuit drawing, shown partially in block diagram form, illustrating the preferred form of the logic elements and functions employed in the central processor unit for assessing the winning vote total during each polling interval and resetting the system for succeeding polling intervals.

Referring now to FIG. 6, the total vote count for each character is likewise applied in binary coded form to one set of inputs to a vote count comparator 94 so as to determine the character receiving the highest number or winning plurality of votes during each polling interval. The vote count comparator 94 preferably consists of two four stage binary comparator circuits of the integrated circuit type 7485 interconnected to receive the four binary bit outputs from both binary coded decimal stages of the counters 90 through the character multiplexer matrices 92. In operation, the count total for each character is compared in the vote count comparator 94 with a previous vote count total contained in a winning vote count register 96. When the vote count total for a particular character received from the multiplexer matrices 92 exceeds that contained in the winning vote count register 96, a first output signal is generated to be applied directly through NOR gates 98 and 100 to clear the previous count from the register 96 and enter the new higher count from the comparator 94.

Also when a new count from the character multiplexer matrices 92 is equal to the count previously entered in the winning count vote register 96, the vote count comparator 94 produces a second "equal" output to be used in randomly selecting one of the characters as a new winner. This equal "signal" from the vote count comparator 94 is applied to the input of a NAND gate 102. The NAND gate 102 is alternately enabled disabled by the alternating output from flip-flop 104 that is periodically switched from one state to the other by timing pulses from a clock source 106 generated at a repetition rate that is preferably an odd submultiple of the count comparison rate. Thus, depending upon the arbitrary state of the flip-flop 104, the NAND gate 102 may or may not be enabled to pass the second output signal generated by the comparator 94 when the counts being compared are equal. If NAND gate 102 is enabled, the equal pulse outut from comparator 94 is applied through NOR gate 100 to the winning count register 96 that is cleared to reenter the same count.

The pulse signals from the NOR gate 100, which indicate the presence of a new winning character, are also replied to a winning character register 108 to clear the previous character address code stored therein and enter the current address code for the new winning character from a character address counter 110. The character address counter 110 is a conventional five stage binary counter, which may consist of a four stage integrated circuit counter with the final stage output coupled in conventional fashion to a flip-flop that serves as the fifth stage, pulses at a frequency of 100 hertz or more are supplied from a clock source 111 to advance the character address count so that the output of the character address counter 110 delivered to the character multiplexer matrices 92 addresses each of the character counters 90 in sequence to deliver their count totals to the vote count comparator 94. After reaching the maximum count of 32, at which time the vote totals for all characters have been compared to determine the winning count, a pulse output from the last stage of the character address counter 110 is delivered to set a flip-flop 112, which then generates a "win pulse" to actuate the winning character display panel 24 that also receives the binary coded address of the winning character from the winning character register 108. An appropriate read out device, such as a 32 position projection read out or an appropriate light emitting diode array can thus be actuated by the "win " pulse to display the character indicated by the binary code from the winning character register 108.

After each predetermined polling interval, the character address counter 110 and the winning vote count register 96 receive a short duration outut pulse from one shot 114 that clears the various binary stages to initiate a new comparison cycle. The initiation of a comparison cycle to determine the winning character for each polling interval can be automatically controlled by various setting from the panel controls 20. These panel controls 20 may include various thumbwheel settable code converters or the like for selecting a desired total vote number, winning vote total, or time interval setting to automatically initiate the comparison cycle. In addition, simple two positions switches (not shown) with "off" and "on" positions can be used for selectively actuating one or more of these automatic controls as desired, together with a manually operated switch that permits the operator to terminate a polling interval and initiate the comparison cycle at will when the automatic controls are not being used.

For example, the panel controls 20 might be set to provide a binary coded total vote number as an input to a total vote comparator 116. The number might be selected to equal to all or most of the total voting entities participating. The binary coded bits for the selected number are matched against corresponding binary bit outputs from a total vote binary counter 118 that has its count incremented by each vote pulse from NAND gate 76 (FIG. 4). When the total vote count contained in the binary counter 118 reaches that supplied from the panel controls 20, the comparator 116 delivers an output to a NAND gate 120, which is maintained normally enabled by an input from the positive supply source coupled through a resistor 122. A two position switch (not shown) on the panel controls 20 permits the normally enabling positive input to be grounded to disable the NAND gate 120, thus shutting off this control.

Similarly, a binary coded winning vote total may be supplied from the panel controls 20 to a winning vote comparator 124 to be compared against the binary coded vote count being supplied continuously from the character multiplexer matrices 92. During each polling interval before the comparison cycle is initiated, the clock source 111 continues to supply pulses to the character address counter 110 so that the accumulating totals in each of the binary counters 90 are read out repetitively through the character multiplexer matrices 92. When the accumulating total in one of the counters 90 equals or exceeds the winning vote total setting, the winning vote comparator 124 delivers an input to a NAND gate 126 that is normally enabled by the positive input through the resistor 128 and disabled by grounding the input through a panel control switch.

Likewise a binary code corresponding to a desired time setting may be supplied by adjusting appropriate dials on the panels controls 20 to supply a binary coded number to a timer comparator 130 which compares the time setting with the total count being accumulated in a timer clock binary counter 132 which counts the pulses from a timer clock 134. The frequency of the pulses from the timer clock may conveniently be one each second or fraction of a second as desired, and the time setting chosen represents the maximum predetermined duration for a giving polling interval. When the total in the timer clock binary counter equals the binary coded time setting, the timer comparator 130 generates an output signal at the input of a NAND gate 136 that receives a positive enabling input through a resistor 138. As before, this NAND gate 136 is disabled by grounding the input through an appropriate timer switch on the panel controls 20 to shut off this automatic function.

The oututs from each of three NAND gates 120, 126 and 136 are connected as inputs to a NOR gate 140 to apply an actuating input to a one shot 142, thereby initiating a comparison cycle whenever any one of the three predetermined automatic setting conditions is satisfied. The one shot 142 is maintained in its normal reset state by a positive input applied through a resistor 144 to charge a capacitor 146. Alternatively, a switch 148, which may be provided with the panel controls 20, can be manually operated to discharge the capacitor 146 to ground to cause the one shot 142 to initiate a comparision cycle at any desired time. The pulse output produced by the one shot 142 is applied to set a flip-flop 150, that has been placed in its reset state by the reset signal generated as hereinafter explained at the end of the previous comparison cycle. The flip-flop 150 delivers a keyboard enable pulse from its set output to the NAND gate 88 (FIG. 4) in the demultiplexer/decoder 14 that acts to actuate the demultiplexer matrices 82 and 84 to deliver each vote pulse to the appropriate character counter 90. The output pulse from the one shot 142 is also applied to actuate the one shot 114 at its positive going trailing edge to initiate the comparison cycel.

The "win" output from flip-flop 112 is also applied to reset another flip-flop 152 to produce a delayed reset signal used to restore the system to its original condition at the start of each new polling interval. The flip-flop 152 is normally maintained in its set state by the positive supply voltage applied through a resistor 154 to its set input. This input can be grounded through a reset switch (not shown) on the panel controls to eliminate the automatic resetting of the system, in which case the system can be reset manually by the operator opening his panel switch. Normally, however, the constant positive set input returns the flip-flop 152 to its set state immediately upon cessation of the positive "win" pulse from flip-flop 112. The reset output from the flip-flop 152 is applied to the base of a switching transistor 156 which is rendered fully conducting, thus grounding its collector terminal, to deliver a negative going or low "reset" pulse to the NAND gate 60 of each keyboard selector unit 10 (FIG. 2) to permit another vote output. This reset pulse is also applied to the flip-flop 150 to generate the keyboard enable pulse as described hereinbefore.

Where two, or possibly more, votes are to be made from each keyboard selector unit 10 during each polling interval, a "reset" signal can be supplied by manually closing and then opening the reset switch (not shown) on the panel controls 20 to switch flip-flop 152 to its reset state and then back to its normal set state without initiating the winning vote count comparison cycle.

As previously indicated, if an examination of subvoice communication is designed through selection and display of the character receiving the next highest plurality of votes, instead of that receiving the highest, this can be accomplished automatically simply by addition of a subsidiary vote count comparator and register arrangement. The additional vote count register would, upon detection of a new winning vote count, receive the count previously stored in the winning vote count register 96 to be compared with successive vote counts received from the character multiplexer matrices 92. The additional comparator would be disabled during this transfer operation by the output from NOR gate 100 indicating a new winner, but would otherwise compare the previous winning count with each successive incoming count from the character multiplexer matrices 92 and would transfer the incoming count into the register whenever it exceeds the previous winning count already stored. A subsdiary character address register would likewise receive the previous winner address from the winning character register in response to an output from NAND gate 100 and be actuated to store the current address from the character address counter 110 when the comparator signals a new second place winner. Outputs from the address register can then be coupled to a subsidiary subvoice display to identify the second place character.

The preferred form of existing system design has been described to illustrate the nature of the invention, but various modifications in the components, logic sequences and other details as may be desired or necessary to accomplish the basic computational functions described and claimed herein should be obvious to those skilled in the computer and communications fields, without departing the scope of the invention as set forth in the appended claims. In particular, the various logic functions have been described and illustrated herein relative to specific types of negating NOR and NAND logic commonly used in the most economical and readily available integrated circuit components, although analogous OR and AND arrangements could be employed if desired.

What is claimed is:

1. A communication system for facilitating formation of a message consisting of successive informational characters chosen by a plurality of the individual voting entities constituting a group, comprising:

a plurality of keyboard selector units operable during each polling interval to manifest any one of a variety of coded output signals indicative of a selected informational character;

a plurality of vote counting means each responsive to a respective one of said coded output signals for registering a vote total indicative of the number of voting entities selecting the associated informational character during a polling interval; and, winning vote detecting means responsive to a sequential comparison of the vote totals accumulated in each said counting means upon termination of each polling interval for detecting the informational character selected by a predetermined plurality of said voting entities during the preceding polling interval; and means for selectively signaling the termination of each polling interval to initiate the operation of said winning vote detecting means.

2. The system of claim 1 further comprising:

display means responsive to the operation of said winning vote detecting means for displaying to each of said voting entities a representation of the informational character detected to have been selected by said predetermined plurality of voting entities during preceding polling intervals.

3. A communication system for facilitating formation of a message using successive choices of informational characters by individual voting entities within a group, comprising:

plurality of selector unit means each providing a predetermined variety of informational characters to be selected by one of said voting entities and output means for generating a coded electrical signal indicative of the informational character selected;

means for receiving the coded electrical signals generated by each of the plurality of selector unit means;

decoding means coupled to said receiving means and responsive to each coded electrical signals received to generate a distinct vote output for each informational character that corresponds to the coded electrical signal being received;

a plurality of means for counting each of said distinct vote outputs from said decoding means during a predetermined polling interval for registering the total number of voting entities selecting each informational character during a given polling interval;

means for signaling the initiation and termination of each polling interval;

means responsive to the signaling of the termination of each polling interval for comparing the total number contained in each of said counting means to detect the informational character having a predetermined plurality relative to the total number of voting entities selecting each other informational character and for producing a winning signal output indicative of said detected informational character; and, means responsive to said winning signal output for communicating to each of said voting entities the identity of said detected character as the next successive element of said message, said signaling means being responsive to said winning signal output to signal initiation of a subsequent polling interval.

4. The communication system of claim 3 wherein:

each of said selector unit means includes timing means responsive to the initial generation of said coded electrical signal for disabling said output means after a predetermined code pulse interval for the duration of each polling interval and responsive to said signaling means for subsequently enabling said output means upon signaling of the initiation of a subsequent polling interval.

5. The system of claim 3 wherein:

said signaling means includes a total vote control means for setting a selectable vote number corresponding to the total vote entities, a total vote detector responsive to each coded electrical signal from said receiving means for counting all the informational characters selected during a polling interval, and means for comparing said selectable total vote number with the count for said total vote detector to signal the termination of a polling interval when the total vote count reaches the total vote number selected by said total vote control means.

6. The system of claim 3 wherein:

said signaling means includes a timer control means for selectively establishing a time setting corresponding to a desired time limit for each polling interval, clock means for registering elapsed time from the initiation of each polling interval, and means for comparing said elapsed time registered with said time setting for signaling the termination of a polling interval when the elapsed time registered equal the time setting.

7. The system of claim 3 wherein:

said signaling means includes a winning vote control means for setting a selectable winning vote number corresponding to a predetermined proportion of the total voting entities participating, and winning vote comparison means responsive to the number contained in each of said counting means for signaling the termination of a polling interval when the count contained in any one of said counting means exceeds the winning vote number selected by said winning vote control means.

8. The communication system of claim 3 further comprising:

digital display means responsive to the total number registered in said counting means for each informational character for indicating the total number of voting entities selecting each informational character during the preceding polling interval.

9. The communications system of claim 3 wherein:

said comparing means includes means for registering the coded electrical signal indicative of the informational character detected to have said predetermined plurality; and, further comprising a winning character display means responsive to said coded electrical signal in said registering means and to said winning signal output for displaying a representation of said detected informational character as an element of the message being formed.

10. The communication system of claim 3 wherein:

said selector unit means includes timing means responsive to the initial generation of said coded electrical signal for disabling said output means after a predetermined code pulse interval and means selectively operable for resetting said timing means in each of said plurality of selector unit means to permit other voting entities to select another one of said informational characters during each polling interval, whereby each selector unit means is capable of generating at least two of said coded electrical signals during each polling interval.

* * * * *